United States Patent [19]

Kuriyama

[11] Patent Number: 4,897,932

[45] Date of Patent: Feb. 6, 1990

[54] MASTER OPTICAL DISK HEAT-DRYING APPARATUS

[75] Inventor: Kazumi Kuriyama, Yamanashi, Japan

[73] Assignees: Pioneer Electronic Corporation, Tokyo; Pioneer Video Corporation, Yamanashi, both of Japan

[21] Appl. No.: 322,941

[22] Filed: Mar. 14, 1989

[30] Foreign Application Priority Data

| | | | |
|---|---|---|---|
| Sep. 2, 1988 | [JP] | Japan | 63-219979 |
| Sep. 2, 1988 | [JP] | Japan | 63-219980 |
| Sep. 2, 1988 | [JP] | Japan | 63-219981 |
| Sep. 2, 1988 | [JP] | Japan | 63-219982 |

[51] Int. Cl.[4] ..... F26B 19/00

[52] U.S. Cl. ..... 34/52; 34/90; 34/184; 34/236

[58] Field of Search ..... 34/7, 39, 184, 236, 34/48, 52, 46, 60, 90; 118/58, 642

[56] References Cited

U.S. PATENT DOCUMENTS

| | | | |
|---|---|---|---|
| 2,256,825 | 9/1941 | Christman | 34/184 |
| 4,724,619 | 2/1988 | Poli et al. | 34/184 |

*Primary Examiner*—Henry A. Bennett
*Assistant Examiner*—John Sollecito
*Attorney, Agent, or Firm*—Sughrue, Mion, Zinn, Macpeak & Seas

[57] ABSTRACT

An apparatus for drying optical disks heats a disk from the underside, and optionally blows clean air between the heater and the disk being dried in order to prevent contaminants from landing on the disk. Heat control is provided such that a surface temperature of the disk during drying is maintained uniform, preventing brittleness. The apparatus preheats the heater, placing the disk in a standby position during warm-up. The apparatus then moves the disk over the heater, and monitors the temperature of the disk, removing the disk back to the standby position when the disk reaches a predetermined temperature. In order to provide uniform heating, a radiant heat controlling plate having a suitably-shaped opening portion may be provided. Additionally, temperature distribution throughout the disk may be achieved as desired, in accordance with the heat control performed, and/or in accordance with the shape of the opening portion of the radiant heat controlling plate.

13 Claims, 4 Drawing Sheets

MASTER OPTICAL DISK HEAT-DRYING APPARATUS

BACKGROUND OF THE INVENTION

The present invention relates to a master optical disk heat-drying apparatus in which a master optical disk is radiation-heated with a far-infrared or infrared heater.

A conventional heat-drying apparatus, known as a heat tunnel, is shown in FIGS. 1(A) and 1(B). In such a heat-drying apparatus, a material to be heated (hereinafter referred to "objective material") 61 is conveyed by a belt conveyor 62 into a tunnel constituted by a plurality of heaters 63 to heat-dry the objective material 61 by thermal conduction due to tunnel temperature while the objective material is passed through the tunnel.

However, such a heat-drying apparatus is deficient, for the following reasons. The apparatus is arranged such that the objective material 61 is placed on the belt conveyor 62 on the opposite side of the apparatus from that where the objective material 61 is withdrawn from the apparatus. Accordingly, in the case where there is only one operator to perform both the insertion and the withdrawal, and the objective material is a master optical disk, workability is exceedingly poor because the apparatus is large, and because close attention must be paid to treatment of the master disk.

There is another reason that such a heat-drying apparatus is deficient. The apparatus is arranged such that the objective material 61 is mounted with its surface to be heated facing up on the belt conveyor 62, so that the surface to be heated is heated from above. Accordingly, in the case where the objective material 61 is a master optical disk, there is a risk that the surface of the master optical disk to be heated may become contaminated with impurities, such as particles or the like falling on the surface by gravity. Consequently it is necessary to take steps to prevent such contamination.

The heat-drying apparatus has still another defect in that control of temperature distribution on the surface of the objective material 61 to be heated cannot be carried out, because the temperature distribution depends on the heat capacity of the heaters 63, the conveying speed of the belt conveyor 62, and the thermal characteristics and shape of the objective material 61.

Since heating is performed through thermal conduction due to atmospheric temperature in the tunnel, the temperature on the surface of the objective material 61 to be heated is unevenly distributed over the whole surface, that is, the surface temperature is low in the central and outermost peripheral portions and high in an intermediate portion. For an optical recording glass master disk with one surface coated with a photoresist, the surface temperature of the glass master disk increases, up to a point, as a function of radial position from the inner circumference toward the outer circumference, but then decreases so as to become lower at the outermost circumference, as shown in the graph (c) in FIG. 2. Thus, if the temperature in a heat-drying process varies, the sensitivity of the photoresist also varies, thereby affecting the shapes of pits by which information is recorded. Further, it has been confirmed by the inventor that if the heating temperature at the outermost peripheral portion is low the glass master disk is likely to break.

FIG. 3 shows a conventional heat-drying apparatus in which temperature distribution can be controlled. This heat-drying apparatus is arranged such that an objective material 61 is heat-dried by heaters 63' which are arranged at varying distances from the objective material 61. In this case, the heat-drying treatment can be performed even if the objective material 61 is moving, rotating, or standing still.

In this heat-drying apparatus, the temperature distribution can be controlled to a certain extent. However, this apparatus is deficient in that space utilization is poor. This is because the temperature distribution is controlled on the basis of the distance between each heater 63 and the objective material 61, and depending on the size of the objective material 61 it becomes impossible to control the temperature distribution because of the relation between the size of the material and the size of the heaters 63'.

SUMMARY OF THE INVENTION

In view of the foregoing, it is one object of the present invention to eliminate the foregoing defects.

Another object of the present invention is to provide a master optical disk heat-drying apparatus which is superior in workability, which is reduced in size, which effectively protects the surface of the master optical disk to be heated from being contaminated with impurities such as dust, particles, etc., and which more accurately controls the temperature distribution on the surface to be heated.

The heat-drying apparatus for a master optical disk according to the present invention is arranged such that the master optical disk can be displaced between a first position, that is, a stand-by position, and a second position, that is, a heat-drying position, in a state in which the master optical disk is rotatably carried. A heater for radiation-heating the master optical disk is provided at the heat-drying position so as to be partially opposed to a radial region of the master optical disk. Control is performed such that the master optical disk is displaced from the stand-by position to the heat-drying position when the temperature of the heater has reached one predetermined value, and the master optical disk is displaced from the heat-drying position to the stand-by position when the surface temperature of the master optical disk has reached another predetermined value. Further, the master optical disk is carried above the heater so as to be parallel with and opposite to the heater, and the heat-drying treatment is performed while clean air is sent at least between the heater and the master optical disk. The distribution of the amount of radiation of infrared rays from the heater onto the master optical disk is controlled by a heat control.

BRIEF DESCRIPTION OF THE DRAWINGS

The foregoing and other objects of the present invention now will be described in detail with reference to the accompanying drawings, in which.

DETAILED DESCRIPTION OF THE PREFERRED EMBODIMENT

Figure 4:
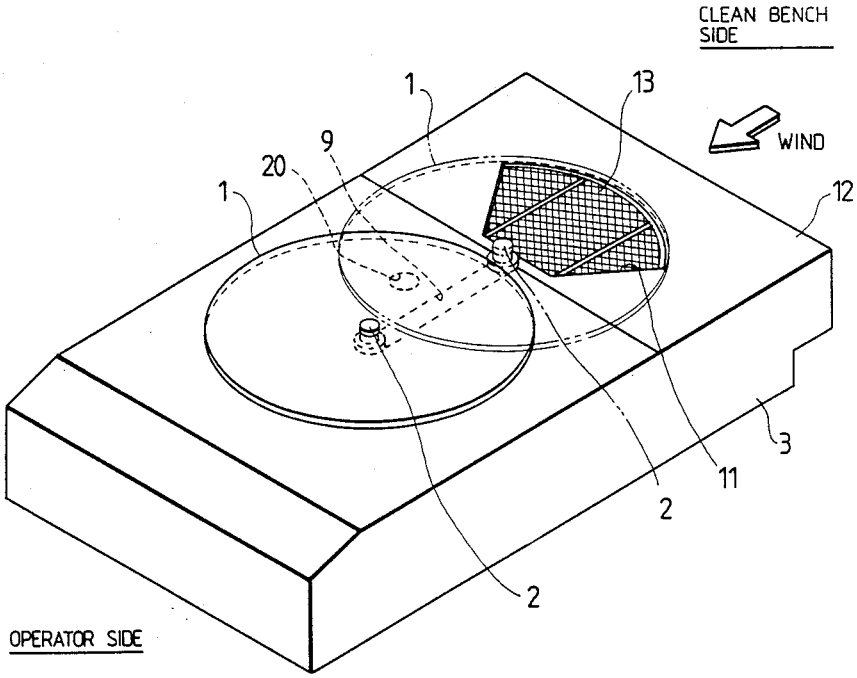
FIG. 4 shows the exterior of one embodiment of the present invention.
Figure 5:
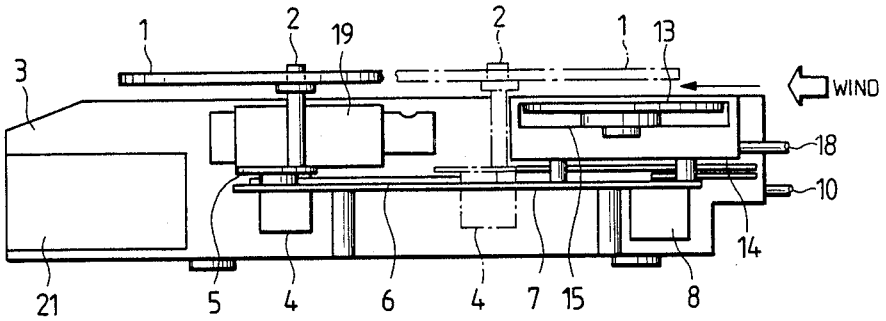
FIG. 5 shows a side view of the configuration of the embodiment.

In FIGS. 4 and 5, a glass master disk 1, which is a master optical disk, is coated on one surface with a photoresist, and is carried by a spindle 2 with that surface facing down. The spindle 2 is rotated by a spindle motor 4 housed in a casing 3. The spindle 2 and the spindle motor 4 are mounted on a spindle base 5. The spindle base 5 is driven by a spindle base driving motor 8 so as to be conveyed on a main base 7 while being guided by a linear slide 6, so that the spindle 2 is displaced from the position indicated by a solid line to another position indicated by a one-dot chain line, along an elongated hole 9 which is formed in an upper surface of the casing 3 so as to have a length substantially equal to the radius of the glass master disk 1. The solid-line position is a stand-by position. In this stand-by position, the glass master disk 1 is loaded and unloaded, and also is cooled after heat treatment. The one-dot chain line position is a heat-drying (baking) position, in which a heat-drying treatment on the glass master disk 1 is performed.

The heat-drying apparatus according to the present invention is mounted on a horizontal air current clean bench which acts as a blower, and is used in a clean room. The apparatus is arranged so that the left side thereof in FIG. 4 is a "working person side" and the right side thereof in the drawing is a "clean bench side". In this positional relation, contamination during drying (drying being the function during Which a disk is most susceptible to contamination) can be minimized. That is the apparatus according to the present invention copes with contamination so that the operator (who may be a dust generating source) is made always to work on the left side of the clean room; the particles are carried away outside by a cleaning air current (as shown by an arrow in FIG. 5). and the glass master disk 1 is set with its surface to be heated facing down; and the inside of the casing 3 is exhausted by an exhaust tube 10 to guard against dust generated from the apparatus mechanism. Further, the upper surface of the casing 3 is made even into one plane in principle except several opening portions formed therein, thereby preventing contaminant particles from accumulating on the upper surface, and also facilitating cleaning.

Figure 6:
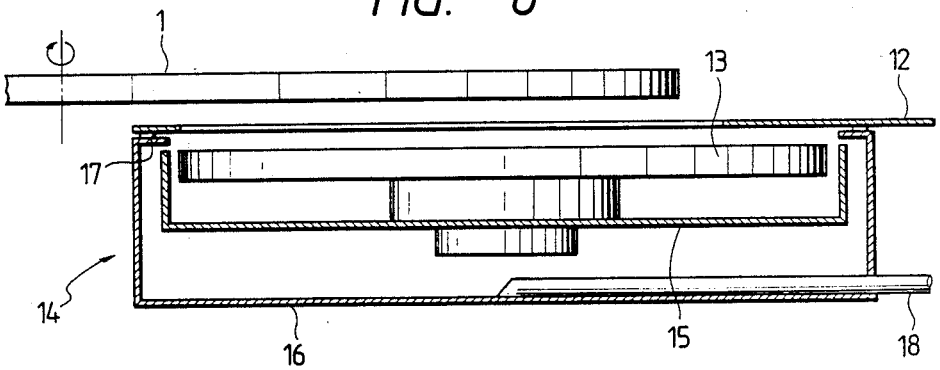
FIG. 6 is an enlarged sectional view showing the heater unit of FIG. 5.

A part of the upper surface of the casing 3 on the clean bench side is formed of a radiant heat shielding plate 12 having a substantially fan-shaped opening portion 11. The radiant heat shielding plate 12 may be made of stainless steel, for example, and may be integrally formed with the casing 3. A heater unit 14 is disposed below the opening portion 11 and includes far-infrared or infrared heater elements 13 for radiation-heating the glass master disk 1 through the opening portion 11. In the heater unit 14 the heater elements 13 are attached on a heater attachment plate 15 so as to be partially opposed to the radial region of the glass master disk 1 located at the heat-drying position, and fixed on an outside plate 16 by a support (not shown) as shown in FIG. 6.

The radiant heat shielding plate 12 is fixed on an upper portion of the outside plate 16 through a spacer 17 used also as a insulator. A jacket portion constituted by the heater attachment plate 15 and the outside plate 16 is exhausted by an exhaust tube 18 to keep the heater elements 13 in negative pressure, so that the heater elements 13 do not generate thermal diffusion type contamination in heating. Further by exhausting the heater unit 14, transmission of unnecessary heat is prevented to prevent the temperature of the apparatus from rising. The temperature of the heater elements 13 is measured by means of thermocouples (not shown) provided on the heater elements 13.

A radiation thermometer 19 is provided inside the casing 3 for measuring the surface temperature of the glass master disk 1 through a measuring window 20 formed through the upper surface of the casing 3. The measurement output of the radiation thermometer 19 is supplied to a controller 21. The controller 21 may be constituted by a microcomputer or the like, and controls the heat drying treatment of the glass master disk 1, for example, by controlling the temperature of the heater elements 13, the start and stop of rotation of the spindle 2, the conveyance of the spindle 2, and the like.

Figure 7:
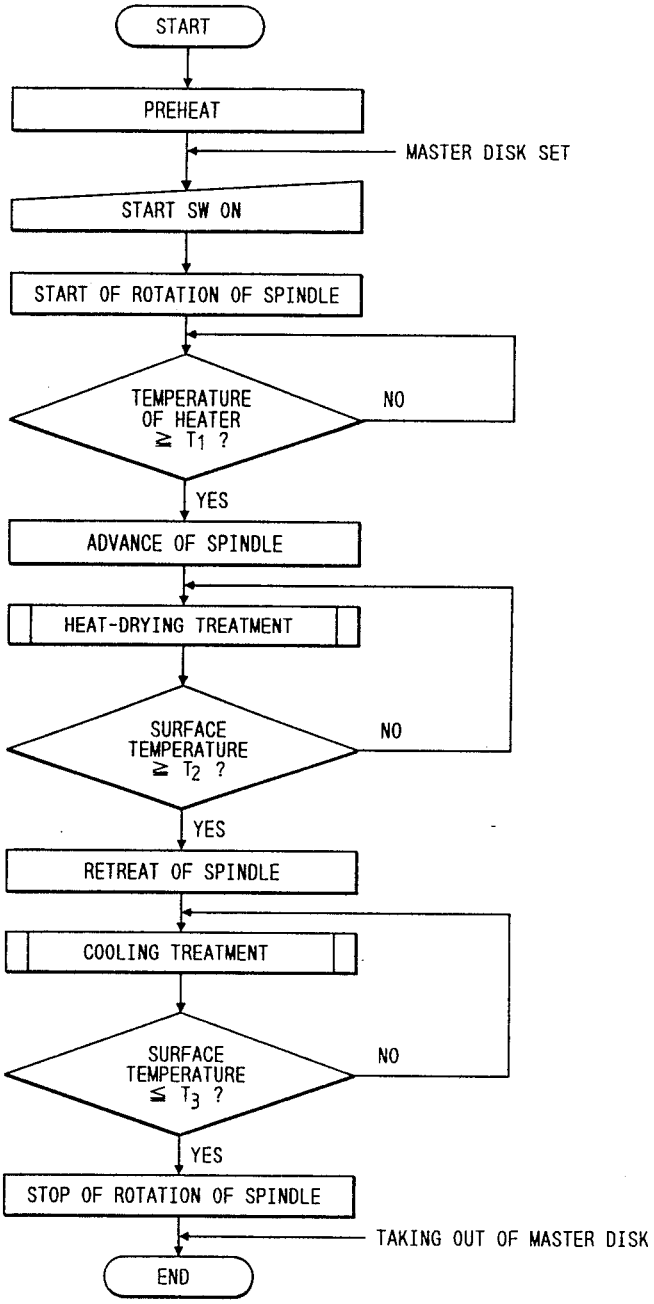
FIG. 7 is a flowchart for explaining the fundamental sequence of the heat-drying routine to be executed by the processor.

Next, referring to the flowchart of FIG. 7, the basic sequence of the heat-drying process to be executed by the processor of the controller 21 will be described.

Upon turning on a power source of the apparatus, the processor starts preheating of the heater elements 13 (step S1). If the temperature of the heater elements 13 has been set to, for example, 215° C., the apparatus is ready when the temperature of the heater elements 13 reaches approximately 215° C. Preheating is performed because it would take a long time for heat-drying if the heater elements 13 were not heated in advance, since the time constant of the heater is large. Temperature measurement is performed by the thermocouples attached to the heater elements 13.

When the glass master disk 1 is set on the spindle 2 and a starting switch (not shown) is turned on (step S2), the processor causes the spindle 2 to rotate at a certain rotational speed, for example, 3 r.p.m. (step S3). When the temperature of the heater elements 13 has reached a set temperature $T_1$, as detected on the basis of the measurement outputs of the thermocouples (step S4), the processor controls the drive of the spindle base driving motor 8 to advance the spindle 2 from the stand-by position to the heat-drying position (step S5). At the heat-drying position, the photoresist on the glass master disk 1 is subjected to heat-drying treatment by radiation heating by the heater elements 13 (step S6).

In the above heat-drying step, when the surface temperature of the glass master disk 1 has reached a predetermined value $T_2$, for example, 90 ± 5° C., as detected on the basis of the measurement output of the radiation thermometer 19 (step S7), the processor controls the drive of the spindle base driving motor 8 to cause the spindle 2 to retreat from the heat-drying position to the stand-by position (step S8). At the stand-by position, cooling of the glass master disk 1 after heating is performed (step S9). When the surface temperature of the glass master disk 1 has reached a predetermined temperature $T_3$ not higher than, for example, 55 ± 0.5° C., as detected on the basis of the measurement output of the radiation thermometer 19 (step S1O), the rotation of the spindle 2 is stopped (step S11). Thereafter, the glass master disk 1 is taken out from the spindle 2 to complete the treatment.

Figure 1A:
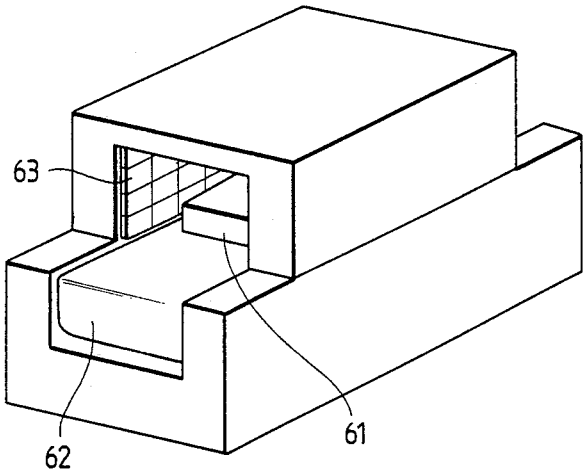
FIG. 1(A) PRIOR ART
FIG. 1(A) shows the exterior of one example of a conventional apparatus.
Figure 1B:
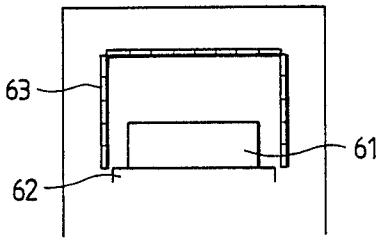
FIG. 1(B) PRIOR ART
FIG. 1(B) is a front sectional view of the conventional apparatus of FIG. 1(A)

Infrared rays tend to travel in a straight line, in the same manner as visible light. Thus, the infrared rays generated from the heater elements 13, in the foregoing heat-drying step, reach the glass master disk 1 located opposite the heater elements 13 through the opening portion 11 of the radiant heat shielding plate 12, and are absorbed by the photoresist so as to generate heat. Generally, the amount of heat generation per unit area in the glass master disk 1 is determined depending on various conditions such as the time during which the glass master disk 1 is opposed to the heater elements 13, the distribution of the quantity of heat generation of the heater elements 13 per se, the efficiency of cooling given by the circumference, and the like. Thus, when the radiant heat shielding plate 12 is not provided, the temperature distribution on the resist surface of the glass master disk 1 is such that the surface temperature is low at the central portion, becomes higher toward the outer circumference, and becomes low again at the outermost circumferential portion because a cooling effect is large, as shown in the graph (b) of FIG. 2. In contrast when the radiant heat shielding plate 12 having the opening portion 11 is provided so as to correct the above-mentioned quantity of heat generation per unit area including all the factors related to the quantity of heat generation by means of the substantially fan-shaped opening portion 11, it is possible to obtain substantially uniform temperature distribution over the whole surface of the glass master disk 1 from the inner circumference to the outer circumference as shown in the graph (a) of FIG. 2. The graph (c) of FIG. 2 shows the characteristics of the conventional apparatus of FIG. 1.

Figure 2:
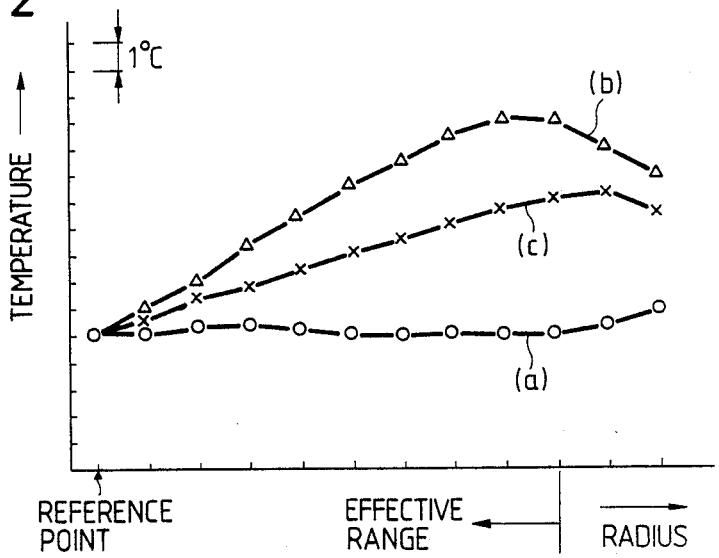
FIG. 2 is a characteristic diagram showing temperature deviations at various radii relative to a reference temperature.
Figure 3:
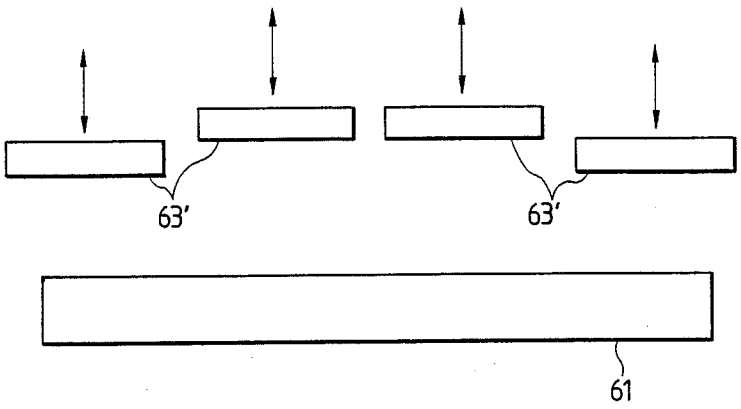
FIG. 3 PRIOR ART
FIG. 3 shows another example of a conventional apparatus.

Further, it is possible to make the surface temperature higher at the outermost circumferential portion of the glass master disk 1 than the other portions, as shown in the graph (a) of FIG. 2, because the fan-shaped opening portion 11 is formed so that the time for heat transmission to the unit area of the glass master disk 1 through the opening portion 11 is made longer at the outermost circumferential portion than at the other portions.

Although the above embodiment been illustrated as to the case where the radiant heat controlling plate 12 having the fan-shaped opening portion 11 is used as a heat controller for controlling the distribution of the quantity of radiation of infrared rays onto the glass master disk 1 from the heater elements 13, the opening portion 11 may be formed to have any desired shape in accordance with the use and purpose thereof.

Further, the heat controller need not be limited to the radiant heat controlling plate 12 having the opening portion 11. Alternatively it is possible to use a radiant heat controlling plate constituted by a combination of materials having thermal properties different from each other, or a radiant heat controlling plate having thermal properties which are different depending on the parts thereof. Still further, it is possible to control the distribution of the quantity of radiation of infrared rays onto the glass master disk 1 by changing the distribution of the quantity of heat generation by the heater elements 13.

Moreover, although the above embodiment has been illustrated as making the temperature distribution more uniform, the temperature distribution also may be adjusted in any manner desired within a range where the adjustment can be performed by the heat controller. Similarly, the temperature and the temperature distribution may be adjusted as desired by the heat controller in combination with proper temperature detecting equipment.

As described above, in the master optical disk heat-drying apparatus according to the present invention, a master optical disk is arranged to be displaceable between a stand-by position and a heat-drying position while the master optical disk is rotatably carried, and a heater for radiation-heating the master optical disk is provided in the heat-drying position so as to be partially opposed to the radial region of the optical master disk. Accordingly, the apparatus can be reduced in size because the displacement of the master optical disk between the stand-by position and the heat-drying position can be performed across a short distance substantially equal to the radius of the master optical disk, and the work can be easily performed even by one operator because all the necessary Work can be performed at the stand-by position.

Further, the apparatus can be made thin because the apparatus is arranged so that the master optical disk can be heated from the underside to make it possible to house the heater within a casing.

Moreover, the master optical disk heat-drying apparatus according to the present invention is arranged so that a master optical disk is carried above a heater for radiation-heating the master optical disk so as to be parallel with and opposite to the heater, and the heat drying treatment is performed while sending clean air at least between the heater and the master optical disk. Thus, it is possible to perform that heat treatment while sending clean air thereto because of radiation heating, and it is possible to surely protect the surface of the master optical disk to be heated from contamination due to impurities such as dust, particles, or the like, because the heating treatment is performed with the surface to be heated facing down.

Further, it is possible to protect the surface of the master optical disk to be heated from dust coming from the mechanism of the apparatus, because the apparatus is arranged so that the inside of the casing is exhausted.

Furthermore, the master optical disk heat-drying apparatus according to the present invention is arranged to perform control so that an optical master disk is displaced from a stand-by position to a heat-drying position when the heater temperature has reached a first predetermined value, and the master optical disk is displaced from the heat-drying position to the stand-by position when the surface temperature of the master optical disk has reached a second predetermined value. Thus, all the necessary work can be performed at the stand-by position, even by only one operator, and therefore it is possible to perform the work easily and to control the temperature of the heater and the surface temperature of the master optical disk.

Moreover, the master optical disk heat-drying apparatus according to the present invention is arranged so that the distribution of the quantity of radiation of infrared rays from a heater onto a master optical disk is controlled by a heat controller. Therefore, it is possible to accurately control the temperature distribution without reducing the space efficiency, and also to improve product quality.

Consequently, for a glass master disk having a surface coated with a photoresist, it is possible to minimize the scattering in sensitivity of the photoresist, because the heating temperature can be made uniform over the entire range from the inner circumference to the outer circumference. Further, it is possible to prevent the glass master disk from breaking because the heating temperature can be made higher at the outermost circumferential portion than at the other portions.

I claim:

1. An apparatus for heat-drying a master optical disk having two major surfaces, said apparatus comprising:
   carrying means for rotatably carrying said master optical disk in a horizontal orientation so that one of said major surfaces of said master optical disk faces up and the other of said major surfaces faces down;
   conveying means for displacing said carrying means between a first position and at second position; and
   heating means for radiation-heating said master optical disk at said second position, said heating means being provided so as to be partially opposed to a radial region of said master optical disk, and so as to heat said one of said major surfaces of said master optical disk which faces down.

2. An apparatus for heat-drying a master optical disk, said apparatus comprising:
   heating means for radiation-heating said master optical disk;
   carrying means for carrying said master optical disk above said heating means so as to be parallel with and opposite to said heating means; and
   air blowing means for sending clean air at least between said heating means and said master optical disk.

3. An apparatus for heat-drying a master optical disk according to claim 2, further comprising a casing for housing said heating means, said casing having a planar surface facing said optical master disk.

4. An apparatus for heat-drying a master optical disk according to claim 3, further comprising exhaust means for exhausting air from the inside of said casing.

5. An apparatus for heat-drying a master optical disk, said apparatus comprising:
   carrying means for carrying said master optical disk thereon;
   conveying means for displacing said carrying means between a first and a second position;
   heating means for radiation-heating said master optical disk at said second position;
   first temperature measuring means for measuring a surface temperature of said master optical disk;
   second temperature measuring means for measuring a temperature of said heating means; and
   control means for controlling driving of said conveying means such that said master optical disk is displaced from said first position to said second position when the temperature of said heating means reaches a first predetermined value, based on an output of said second temperature measuring means, and said master optical disk is displaced from said second position to said first position when the surface temperature of said master optical disk reaches a second predetermined value based on an output of said first temperature measuring means.

6. An apparatus for heat-drying a master optical disk according to claim 5, wherein said carrying means comprises means for rotatably carrying said master optical disk wherein said control means includes means for monitoring the output of said first temperature measuring means after the displacement of said master optical disk to said first position, and wherein said control means stops said carrying means from rotating said master optical disk when the surface temperature of said master optical disk is not higher than a third predetermined value.

7. An apparatus for heat-drying a master optical disk, said apparatus comprising:
   heating means for heating said master optical disk with infrared rays;
   carrying means for carrying said master optical disk to a position opposed to said heating means; and
   heat control means for controlling the distribution of the quantity of radiation of infrared rays from said heating means onto said master optical disk.

8. An apparatus for heat-drying a master optical disk according to claim 7, in which said distribution of the quantity of radiation is controlled by said heat control means so as to make the surface temperature of said master optical disk uniform over the whole surface of said master optical disk.

9. An apparatus for heat-drying a master optical disk according to claim 7, wherein said distribution of the quantity of radiation is controlled by said heat control means so as to make the surface temperature higher at the outermost circumferential portion of said master optical disk than at the other portions.

10. An apparatus for heat-drying a master optical disk according to claim 7, wherein said radiant heat controlling plate comprises a combination of materials having thermal properties different from each other.

11. An apparatus for heat-drying a master optical disk according to claim 7, wherein said radiant heat controlling plate has a thermal property which varies dependent on parts thereof.

12. An apparatus for heat-drying a master optical disk according to claim 7, wherein said heat control means comprises a radiant heat controlling plate having an opening portion so as to control heat transmission in accordance with a shape of said opening portion.

13. An apparatus for heat-drying a master optical disk according to claim 12, wherein said opening portion is substantially fan-shaped.

* * * * *